United States Patent [19]

Leckie et al.

[11] Patent Number: 4,795,490

[45] Date of Patent: Jan. 3, 1989

[54] INERT GAS PURGING DURING SHAFT FURNACE SHUT DOWN

[75] Inventors: James H. Leckie, Huntington; Horace Pops, Fort Wayne, both of Ind.

[73] Assignee: Essex Group, Inc., Ft. Wayne, Ind.

[21] Appl. No.: 136,799

[22] Filed: Dec. 22, 1987

[51] Int. Cl.[4] ..... C22B 15/00

[52] U.S. Cl. ..... 75/76; 75/72; 75/96

[58] Field of Search ..... 75/72, 76, 96

[56] References Cited

U.S. PATENT DOCUMENTS 3,063,828 11/1962 Booth ..... 75/96

3,868,987 3/1975 Galey ..... 75/96

*Primary Examiner*—Peter D. Rosenberg

*Attorney, Agent, or Firm*—James M. Rashid

[57] ABSTRACT

Processes for providing an inert gas protective atmosphere during shut down periods of a copper melting shaft furnace are described. Upon shut down of the furnace, liquid nitrogen is introduced into the furnace interior and forms gaseous nitrogen upon vaporization. A two-stage process is employed with the initial introduction of liquid nitrogen at a high rate to flush out all oxygen bearing atmospheres from the furnace, followed by the introduction of liquid nitrogen at a lower rate sufficient to maintain the protective nitrogen atmosphere.

6 Claims, 1 Drawing Sheet

INERT GAS PURGING DURING SHAFT FURNACE SHUT DOWN

TECHNICAL FIELD

This invention relates to the operation of copper melting shaft furnaces.

BACKGROUND

Copper rod is a commercial commodity produced in vast quantities. A common type of furnace used in producing copper rod is the shaft furnace. Such a furnace is characterized by a generally vertical cylinder having gas burners at the bottom portion of the furnace which melt a copper charge introduced through the top of the furnace. One of the operating characteristics of a copper melting shaft furnace is a substantially continuous counter-current flow of the cold copper charge and the hot gas effluent from the burners.

The products which such furnaces are used to produce include tough pitch copper which contains an intentional amount of about 200 to 800 parts per million by weight (ppmw) of oxygen. The presence of small amounts of oxygen has been found to improve the electrical conductivity of the copper. However, too much oxygen can in itself reduce conductivity and other properties, and it is therefore important to control the oxygen content within narrow limits.

Occasionally, and for any number of reasons, the melting furnace must be shut down. The present practice in such instances is to terminate the flow of combustible gas to the burners, while maintaining a flow of air into the furnace for some period of time to solidify any molten copper in the furnace. However, during the cool down period, the molten copper and the hot copper charge absorb by diffusion processes an unacceptably high amount of oxygen. As a result, the already melted copper is no longer useful without some sort of refinement process, and the copper charge which will be melted when the furnace is restarted will produce a product containing excessively high oxygen levels. To accommodate such contamination, such high oxygen content copper is typically put aside and subsequently melted at a later time. This is an undesirable solution since the copper must be melted more than once and extra oxygen analyses of the melted copper must be performed.

It is known in the heat treatment of solid metal articles to use inert atmospheres, including nitrogen, to control (and preferably prevent) interactions between the article and the atmosphere. It is also known, especially in the casting of steel, to use nitrogen or other inert gas blankets for short time shielding of molten metal in ladles or tundishes.

DISCLOSURE OF THE INVENTION

The problem eliminated by the present invention is oxygen contamination of molten copper and the copper charge during shut down of a copper melting shaft furnace. According to this invention, liquid nitrogen is flowed into the furnace immediately after the termination of combustion in the furnace; the liquid nitrogen vaporizes and undergoes a rapid volumetric expansion in the furnace which purges the furnace atmosphere and prevents the infiltration of the ambient (oxygen containing) atmosphere into the furnace interior. The flow rate of liquid nitrogen into the furnace is chosen to purge the furnace atmosphere within about one minute after the furnace is shut down. Preferably, the flow rate is sufficient to produce, per minute, an amount of gaseous nitrogen which is at least about three times the furnace interior volume. After about two minutes of flowing liquid nitrogen into the furnace at this relatively high primary rate, the flow rate can be reduced to a lower, secondary rate which maintains a nonoxidizing nitrogen atmosphere in the furnace for the duration of the shut down period.

The foregoing, and other features and advantages of the present invention will become more apparent from the following description and accompanying drawing.

BEST MODE FOR CARRYING OUT THE INVENTION

Figure 1:
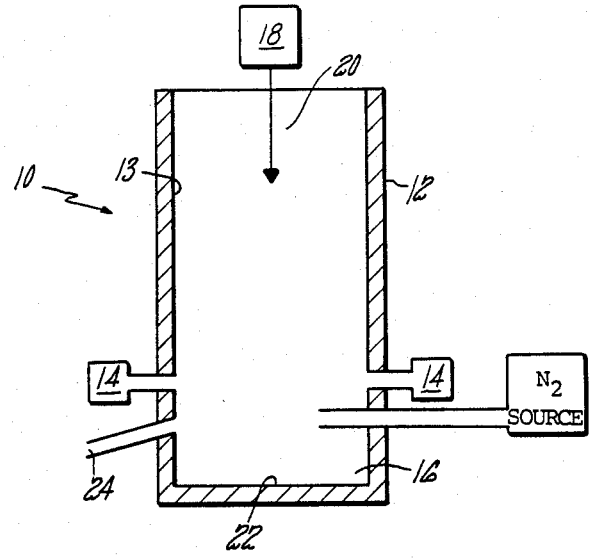
FIG. 1 is a simplified cross sectional view showing a copper melting shaft furnace capable of operating in accordance with this invention.

FIG. 1 illustrates in schematic form the essential features of a copper melting shaft furnace, indicated in the Figure by with the general reference numeral 10. These features include a vertical, generally cylindrical furnace structure 12 and a plurality of burners 14 located near the bottom portion 16 of the furnace 10. The inner walls 13 of the furnace are firebrick or other suitable refractory material. A solid copper charge 18, generally in the form of a copper cathode and/or copper scrap, is introduced through the top portion 20 of the furnace 10. Molten copper produced when the charge melts collects upon a hearth 22 which includes a launder 24 or nozzle to allow for the exit of molten metal from the furnace 10.

The burners 14 are supplied with air and fuel, usually methane gas. Combustion produces an exhaust gas, which is of a reducing nature, which melts the copper charge 18; molten copper drips into the hearth 22 while the hot combustion gases flow upward to preheat the balance of the solid copper charge 18.

Typically, copper melting shaft furnaces have a number of openings, which are not shown in the Figure, which connect the interior of the furnace with the ambient atmosphere. These openings include the hearth 22 and launder 24, spaces surrounding the burners 14, various inspection and measurement ports, and the entire top 20 of the furnace 10 which is open to the atmosphere. During normal furnace operation, the interior of the furnace is maintained at a slight positive pressure thereby essentially eliminating infiltration of the ambient atmosphere into the furnace 10. However, upon furnace shut down, the ambient atmosphere immediately permeates the furnace interior, especially as the hot copper generates upward drafts which draw air into the bottom portion of the furnace 10. It is not practical to seal these apertures, since they are necessary for normal furnace operation. The rapid infiltration of ambient atmosphere into the furnace 10 during shut down causes very rapid and detrimental oxidation of the molten copper on the hearth 22 and of the solid copper charge 18. This is exacerbated by the fact that air is often blown into the furnace interior for some period of time after the cessation of combustion in order to prevent local furnace overheating.

This invention involves a two-stage introduction of liquid nitrogen into the furnace interior immediately upon shut down of the furnace. Liquid nitrogen has a high expansion rate, and each gallon (about 3.8 liters) of liquid nitrogen rapidly expands to form about 93 standard cubic feet (almost 2,670 liters) of gaseous nitrogen when it vaporizes. The key feature of the invention is to introduce liquid nitrogen into the furnace interior immediately after (and preferably, simultaneously with) the termination of combustion in the furnace. The liquid nitrogen rapidly expands in the furnace, forcing out the atmosphere in the furnace and preventing the infiltration of the ambient (oxygen containing) atmosphere into the furnace. The furnace should be completely purged within at least about one minute after termination of combustion. In effect, use of the invention process results in the exchange of the atmosphere present during the melting operation for a nonoxidizing nitrogen rich atmosphere. For the first stage of the invention process, the liquid nitrogen is introduced at a high (primary) rate to insure that a large volume of gaseous nitrogen is produced to replace the atmosphere present during combustion. The primary flow rate should be chosen to produce, in the shortest practical period of time, an amount of gaseous nitrogen which is at least about three times the interior volume of the furnace per minute. In other words, the atmosphere present during combustion (and any of the ambient atmosphere which leaks into the furnace) should be exchanged with the nitrogen atmosphere at least about three times during the first minute of the primary period of the invention. The primary period should last at least about one minute and preferably at least about two minutes. Thereafter, the liquid nitrogen flow rate can be decreased to a level sufficient to maintain a nitrogen rich atmosphere in the furnace. The secondary flow rate should be sufficient to produce a quantity of gaseous nitrogen, per minute, which is at least about one quarter to one times the total furnace volume. The nitrogen atmosphere is therefore exchanged (or replenished) about every one to four minutes during the secondary period, which continues until the furnace is restarted. If, however, the furnace is to be shut down for an extended period of time, the flow of nitrogen may cease when the copper charge cools to below about 300° F. (about 150° C.), a temperature below which diffusion of oxygen into the copper is negligible.

Preferably, the liquid nitrogen is supplied to the furnace via cryogenic containers in the manner schematically shown in the Figure: the nitrogen is forced from a container by applying high pressure gaseous nitrogen to the container. The liquid nitrogen passes through a lance 28 near the bottom of the furnace 10 which introduces the nitrogen near the molten copper on the hearth 22. The liquid nitrogen should not be introduced directly onto any of the internal refractory surfaces, since they may crack or spall as a result of thermal shock.

Upon restart of the furnace, the burners will generate heat, which will heat the nitrogen and expel it through the top of the furnace. The amount of nitrogen present in the furnace is small enough such that there are no safety hazards associated with the restart operation.

EXAMPLE

Figure 2:
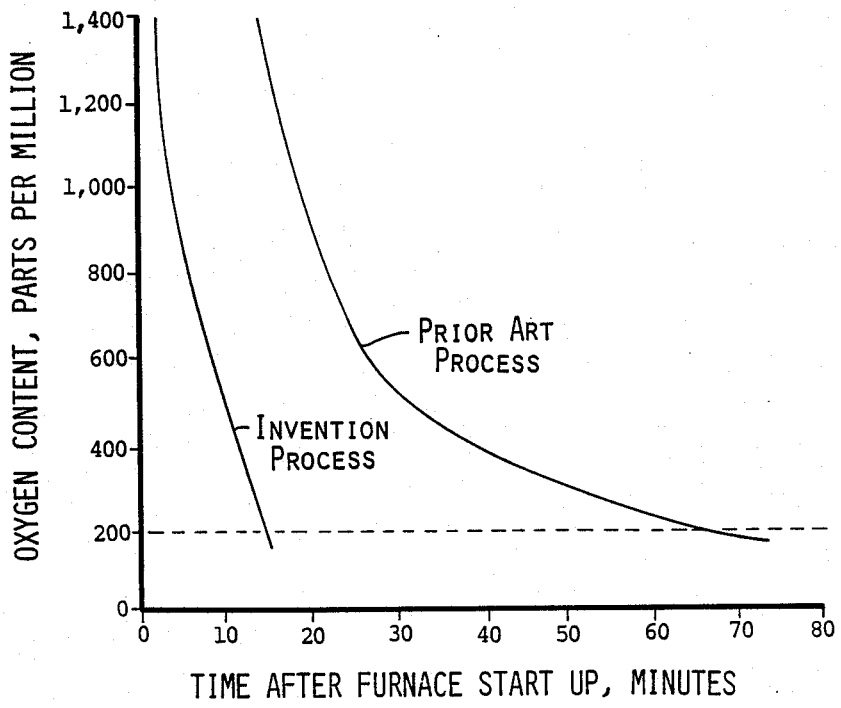
FIG. 2 shows that copper melting shaft furnaces operated in accordance with this invention produce useful copper in a shorter time after furnace shut down than furnaces operated with prior art techniques.

The present process was evaluated in a copper melting shaft furnace having a height of about 30 feet (about 9 meters), a diameter of about 5 feet (about 1.5 meters), and an effective interior gas volume of about 300 cubic feet (about 8,500 liters). After shutting down the furnace by terminating the flow of combustible gases to the furnace burners, the furnace was purged for a period of about 2 minutes by liquid nitrogen introduced at a primary rate of about 15 gallons (about 57 liters) per minute. The primary liquid nitrogen flow rate produced about 1,400 standard cubic feet (about 40,000 liters) of gaseous nitrogen per minute. After about two minutes, the primary flow rate was reduced to a secondary flow rate of about 3¾ gallons (about 14 liters) per minute for the balance of the shut down period. The total shut down period in this evaluation was about 15 minutes and at the end of this time the burners were reignited and the copper was remelted. The oxygen content of the molten copper exiting the furnace after use of the invention process was measured as a function of time and was contrasted with similar measurements made with the previously described prior art practice. The results are shown in FIG. 2. The desired oxygen content was about 200 parts per million and the Figure shows that with the use of the invention process the furnace was able to produce copper of this oxygen content after less than about 15 minutes of operation. When the prior art practice was utilized, it took about 70 minutes to achieve the desired oxygen content. Thus, use of the invention process provides significant economic benefits and substantially increases furnace productivity.

Although this invention has been shown and described with respect to detailed embodiments thereof, it will be understood by those skilled in the art that various changes in form and detail thereof may be made without departing from the spirit and scope of the claimed invention. For example, rather than introducing liquid nitrogen into the furnace during the secondary period of the invention, gaseous nitrogen may be introduced. Gaseous nitrogen may be utilized because the flow rates required during the secondary period are compatible with the flow rates attainable with conventional gaseous nitrogen delivery equipment. However, it is required that liquid nitrogen be introduced during the primary period to rapidly expel the atmosphere present during combustion and to prevent the infiltration of the ambient atmosphere into the furnace.

We claim:

1. A method for minimizing oxidation of copper in a copper melting shaft furnace during a furnace shut down period, comprising the steps of:

(a) terminating combustion in the furnace;

(b) introducing liquid nitrogen into the furnace at a primary rate sufficient to produce, per minute, an amount of gaseous nitrogen which is at least about three times the furnace interior volume; and then (c) introducing liquid nitrogen into the furnace at a secondary rate sufficient to produce, per minute, an amount of gaseous nitrogen which is about one quarter to one times the furnace interior volume.

2. The method of claim 1, comprising introducing the liquid nitrogen into the furnace at the primary rate for at least about one minute.

3. The method of claim 1, comprising introducing the liquid nitrogen into the furnace at the primary rate for at least about two minutes.

4. The method of claim 1, comprising the step of stopping the flow of liquid nitrogen into the furnace when the copper charge therein cools to about 300° F.

5. A method for minimizing oxidation of copper in a copper melting shaft furnace during a furnace shut down period, wherein prior to said shut down period, copper is melted in said furnace by a combustion process which produces a reducing gas atmosphere in the furnace interior, said method comprising the steps of (a) terminating combustion in the furnace, whereby production of said reducing gas atmosphere is terminated;

(b) introducing liquid nitrogen into the furnace at a primary rate sufficient to purge the furnace atmosphere within at least about one minute after terminating combustion; and (c) introducing liquid nitrogen into the furnace at a secondary rate lower than the primary rate after the furnace has been purged, and containing the secondary flow of liquid nitrogen until the temperature of copper in the furnace is below about 300° F.

6. A method for operating a copper melting shaft furnace, comprising the steps of:

(a) introducing a copper charge through the top portion of the furnace;

(b) melting the charge by a combustion process which produces a reducing gas atmosphere at a positive pressure within the furnace interior, such that molten metal drips onto a hearth near the bottom portion of the furnace, and said positive pressure reducing gas minimizes oxidation of the molten metal and copper charge, and infiltration of the ambient atmosphere into the furnace;

(c) removing copper through the bottom portion of the furnace in conjuction with said melting step; and (d) shutting down the furnace by the steps which comprise:

(i) terminating combustion in the furnace;

(ii) introducing liquid nitrogen into the bottom portion of the furnace at a first rate which is sufficient to produce, per minute, an amount of gaseous nitrogen which is at least about three times the furnace interior volume, wherein said gaseous nitrogen purges the furnace atmosphere and oxidation of the molten metal and copper charge are minimized, and then (iii) introducing liquid nitrogen into the furnace at a second rate which is sufficient to produce, per minute, an amount of gaseous nitrogen which is about one quarter to one times the furnace interior volume, wherein said second flow of nitrogen is continued until the copper charge cools to a temperature of about 300° F. or less.

* * * * *